US010246813B2

(12) United States Patent
Herman et al.

(10) Patent No.: US 10,246,813 B2
(45) Date of Patent: Apr. 2, 2019

(54) METHOD FOR DRYING ARTICLES

(71) Applicant: WHIRLPOOL CORPORATION, Benton Harbor, MI (US)

(72) Inventors: Mark L. Herman, Saint Joseph, MI (US); Garry L. Peterman, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 221 days.

(21) Appl. No.: 15/401,138

(22) Filed: Jan. 9, 2017

(65) Prior Publication Data

US 2017/0114494 A1 Apr. 27, 2017

Related U.S. Application Data

(62) Division of application No. 14/100,361, filed on Dec. 9, 2013, now Pat. No. 9,546,817.

(51) Int. Cl.

| | |
|---|---|
| ***H05B 6/54*** | (2006.01) |
| ***H05B 6/46*** | (2006.01) |
| ***D06F 58/26*** | (2006.01) |
| ***F26B 3/34*** | (2006.01) |
| ***D06F 58/04*** | (2006.01) |
| ***F26B 3/347*** | (2006.01) |

(52) U.S. Cl.
CPC ..... *D06F 58/266* (2013.01); *D06F 58/04* (2013.01); *F26B 3/34* (2013.01); *F26B 3/347* (2013.01)

(58) Field of Classification Search
CPC ..... D06F 58/02; D06F 58/04; D06F 58/266; G01R 1/00; G01R 29/0857; G01R 29/12; H05B 6/62; F26B 3/347; F26B 1/00; F26B 3/00; F26B 3/34–3/353
USPC ..... 219/764–780
See application file for complete search history.

(56) References Cited

U.S. PATENT DOCUMENTS

| | | | |
|---|---|---|---|
| 1,503,224 | A | 7/1924 | Blaine |
| 1,871,269 | A | 8/1932 | Hobrock |
| 2,112,418 | A | 3/1938 | Hart, Jr. et al. |
| 2,212,522 | A | 8/1940 | Hart, Jr. et al. |
| 2,228,136 | A | 1/1941 | Hart, Jr. |
| 2,276,996 | A | 3/1942 | Milinowski |
| 2,511,839 | A | 6/1950 | Frye |

(Continued)

FOREIGN PATENT DOCUMENTS

| | | | |
|---|---|---|---|
| EP | 0269358 | A2 | 6/1988 |
| EP | 1753265 | A1 | 2/2007 |

(Continued)

OTHER PUBLICATIONS

European Search Report for Corresponding EP14175081.0, dated Dec. 4, 2014.

(Continued)

*Primary Examiner* — Sang Y Paik
(74) *Attorney, Agent, or Firm* — McGarry Bair PC

(57) ABSTRACT

A method for drying an article with a radio frequency (RF) applicator having anode elements and cathode elements includes capacitively coupling the anode elements, capacitively coupling the cathode elements, capactively coupling an anode element to a cathode element, and energizing the RF applicator to generate an RF field between anode and cathode elements wherein liquid residing within the field will be dielectrically heated.

20 Claims, 10 Drawing Sheets

(56) References Cited

U.S. PATENT DOCUMENTS

| | | | | |
|---|---|---|---|---|
| 2,542,589 | A | 2/1951 | Stanton et al. | |
| 2,582,806 | A * | 1/1952 | Nes | D01D 10/0409 219/770 |
| 2,656,839 | A | 10/1953 | Howard | |
| 2,740,756 | A | 4/1956 | Thomas | |
| 2,773,162 | A | 12/1956 | Christensen | |
| 3,161,480 | A | 12/1964 | Birch-Iensen et al. | |
| 3,184,637 | A | 5/1965 | Skinner | |
| 3,316,380 | A | 4/1967 | Pansing | |
| 3,355,812 | A | 12/1967 | Bennett | |
| 3,364,294 | A * | 1/1968 | Garibian | D02J 1/224 219/770 |
| 3,426,439 | A | 2/1969 | Ryman et al. | |
| 3,439,431 | A | 4/1969 | Heidtmann | |
| 3,537,185 | A | 11/1970 | Ingram | |
| 3,543,408 | A | 12/1970 | Candor et al. | |
| 3,601,571 | A | 8/1971 | Curcio | |
| 3,652,816 | A | 3/1972 | Preston | |
| 3,701,875 | A | 10/1972 | Witsey et al. | |
| 3,754,336 | A | 8/1973 | Feild | |
| 3,878,619 | A | 4/1975 | Hodgett et al. | |
| 3,969,225 | A * | 7/1976 | Horowitz | B03C 7/00 209/127.2 |
| 4,014,732 | A | 3/1977 | Beckert et al. | |
| 4,028,518 | A * | 6/1977 | Boudouris | A61N 5/04 219/770 |
| 4,119,826 | A | 10/1978 | Chambley et al. | |
| 4,197,851 | A | 4/1980 | Fellus | |
| 4,296,298 | A * | 10/1981 | MacMaster | H05B 6/62 219/771 |
| 4,296,299 | A | 10/1981 | Stottmann et al. | |
| 4,365,622 | A | 12/1982 | Harrison | |
| 4,409,541 | A | 10/1983 | Richards | |
| 4,523,387 | A | 6/1985 | Mahan | |
| 4,529,855 | A | 7/1985 | Fleck | |
| 4,638,571 | A | 1/1987 | Cook | |
| 5,152,075 | A | 10/1992 | Bonar | |
| 5,495,250 | A | 2/1996 | Ghaem et al. | |
| 5,838,111 | A | 11/1998 | Hayashi et al. | |
| 5,983,520 | A | 11/1999 | Kim et al. | |
| 6,124,584 | A | 9/2000 | Blaker et al. | |
| 6,531,880 | B1 | 3/2003 | Schneider et al. | |
| 6,812,445 | B2 | 11/2004 | Gorbold | |
| 7,619,403 | B2 | 11/2009 | Kashida | |
| 7,676,953 | B2 | 3/2010 | Magill | |
| 7,883,609 | B2 | 2/2011 | Petrenko et al. | |
| 8,499,472 | B2 | 8/2013 | Bari et al. | |
| 8,826,561 | B2 | 9/2014 | Wisherd et al. | |
| 8,839,527 | B2 | 9/2014 | Ben-Shmuel et al. | |
| 8,943,705 | B2 | 2/2015 | Wisherd et al. | |
| 9,127,400 | B2 | 9/2015 | Herman et al. | |
| 9,173,253 | B2 | 10/2015 | Wohl et al. | |
| 9,194,625 | B2 | 11/2015 | Herman et al. | |
| 9,200,402 | B2 | 12/2015 | Wisherd et al. | |
| 9,410,282 | B2 | 8/2016 | Herman et al. | |
| 9,447,537 | B2 | 9/2016 | Wisherd et al. | |
| 9,540,759 | B2 | 1/2017 | Herman et al. | |
| 9,605,899 | B2 | 3/2017 | Herman | |
| 9,784,499 | B2 | 10/2017 | Herman | |
| 2002/0047009 | A1 | 4/2002 | Flugstad et al. | |
| 2004/0149734 | A1 | 8/2004 | Petrenko et al. | |
| 2005/0120715 | A1 | 6/2005 | Labrador | |
| 2005/0286914 | A1 | 12/2005 | Nagahama | |
| 2006/0097726 | A1 | 5/2006 | Frederick et al. | |
| 2006/0289526 | A1 | 12/2006 | Takizaki et al. | |
| 2007/0045307 | A1 | 3/2007 | Tsui et al. | |
| 2009/0172965 | A1 | 7/2009 | Campagnolo et al. | |
| 2009/0195255 | A1 | 8/2009 | Kalokitis et al. | |
| 2010/0115785 | A1 | 5/2010 | Ben-Shmuel et al. | |
| 2011/0308101 | A1 | 12/2011 | Wisherd et al. | |
| 2012/0164022 | A1 | 6/2012 | Muginstein et al. | |
| 2012/0247800 | A1 | 10/2012 | Shah et al. | |
| 2012/0291304 | A1 | 11/2012 | Wisherd et al. | |
| 2013/0119055 | A1 | 5/2013 | Wohl et al. | |
| 2013/0207674 | A1 | 8/2013 | Hahl et al. | |
| 2013/0271811 | A1* | 10/2013 | Lam | E06B 9/24 359/266 |
| 2014/0325865 | A1 | 11/2014 | Wisherd et al. | |
| 2015/0020403 | A1 | 1/2015 | Herman et al. | |
| 2015/0089829 | A1 | 4/2015 | Herman et al. | |
| 2015/0101207 | A1 | 4/2015 | Herman et al. | |
| 2015/0102801 | A1 | 4/2015 | Herman et al. | |
| 2015/0159949 | A1 | 6/2015 | Herman et al. | |

FOREIGN PATENT DOCUMENTS

| | | | |
|---|---|---|---|
| EP | 2827087 | A1 | 1/2015 |
| EP | 2840340 | A2 | 2/2015 |
| EP | 3073008 | A1 | 9/2016 |
| GB | 601855 | A | 5/1948 |
| GB | 1255292 | | 12/1971 |
| GB | 2019543 | A | 10/1979 |
| JP | 4307095 | A | 10/1992 |
| WO | 2009106906 | A1 | 9/2009 |
| WO | 2012001523 | A2 | 1/2012 |

OTHER PUBLICATIONS

European Search Report for Corresponding EP141785683., dated Feb. 16, 2015.

"British Help American Wounded: Rehabilitation and Treatment, UK, 1944", Ministry of Information Second World War Official.

European Search Report for Corresponding EP14179021.2, dated Feb. 3, 2015.

European Search Report for Counterpart EP16155782.2, dated Jul. 28, 2016.

* cited by examiner

METHOD FOR DRYING ARTICLES

CROSS-REFERENCE TO RELATED APPLICATIONS

This application is a divisional of U.S. patent application Ser. No. 14/100,361, filed Dec. 9, 2013, now U.S. Pat. No. 9,546,817, issued Jan. 27, 2017, which is incorporated herein by reference in its entirety.

BACKGROUND OF THE INVENTION

Dielectric heating is the process in which a high-frequency alternating electric field heats a dielectric material, such as water molecules. At higher frequencies, this heating is caused by molecular dipole rotation within the dielectric material, while at lower frequencies in conductive fluids, other mechanisms such as ion-drag are more important in generating thermal energy.

Microwave frequencies are typically applied for cooking food items and are considered undesirable for drying laundry articles because of the possible temporary runaway thermal effects random application of the waves in a traditional microwave. Radio frequencies and their corresponding controlled and contained e-field are typically used for drying of textile material.

When applying an RF electronic field (e-field) to a wet article, such as a clothing material, the e-field may cause the water molecules within the e-field to dielectrically heat, generating thermal energy which effects the rapid drying of the articles.

BRIEF DESCRIPTION OF THE INVENTION

In one aspect, the disclosure relates to a laundry drying applicator to dry an article, including a support element, a first anode element and a first cathode element, a second anode element capacitively coupled with the first anode element and operably separated by at least a portion of the support element, and having a first base from which extends a first plurality of teeth and a first plurality of tabs on at least some of the first plurality of teeth, a second cathode element capacitively coupled with the second first element and operably separated by at least a portion of the support element and having a second base from which extends a second plurality of teeth, and a second plurality of tabs on at least some of the second plurality of teeth wherein the first and second plurality of teeth are interdigitally arranged, and a radio frequency (RF) generator coupled with the first anode element and the first cathode element and operable to energize the first anode element and the first cathode element. Upon energization of the first anode element and the first cathode element by the RF generator, the capacitive coupling of the second anode element and the second cathode element generates a field of electromagnetic radiation (e-field) in the radio frequency spectrum, operable to dielectrically heat liquid within an article on the support element.

In another aspect, the disclosure relates to a method to dry an article with a radio frequency (RF) applicator having a first anode element, a second anode element having a first base from which extends a first plurality of teeth and a first plurality of tabs on at least some of the first plurality of teeth, a first cathode element, a second cathode element having a second base from which extends a second plurality of teeth and a second plurality of tabs on at least some of the second plurality of teeth, each second anode and second cathode elements supported on a support element. The method includes capacitively coupling, through the support element, the first anode element to the second anode element and the first cathode element to the second cathode element, capacitively coupling the second anode element to the second cathode element, and energizing the RF applicator to energize the first anode element and the first cathode element, to generate a field of electromagnetic radiation (e-field) within a radio frequency spectrum between the second anode and second cathode elements. Liquid in the article residing within the e-field will be dielectrically heated to effect a drying of the article.

DESCRIPTION OF EMBODIMENTS OF THE INVENTION

While this description may be primarily directed toward a laundry drying machine, the invention may be applicable in any environment using a radio frequency (RF) signal application to dehydrate any wet article.

Figure 1:
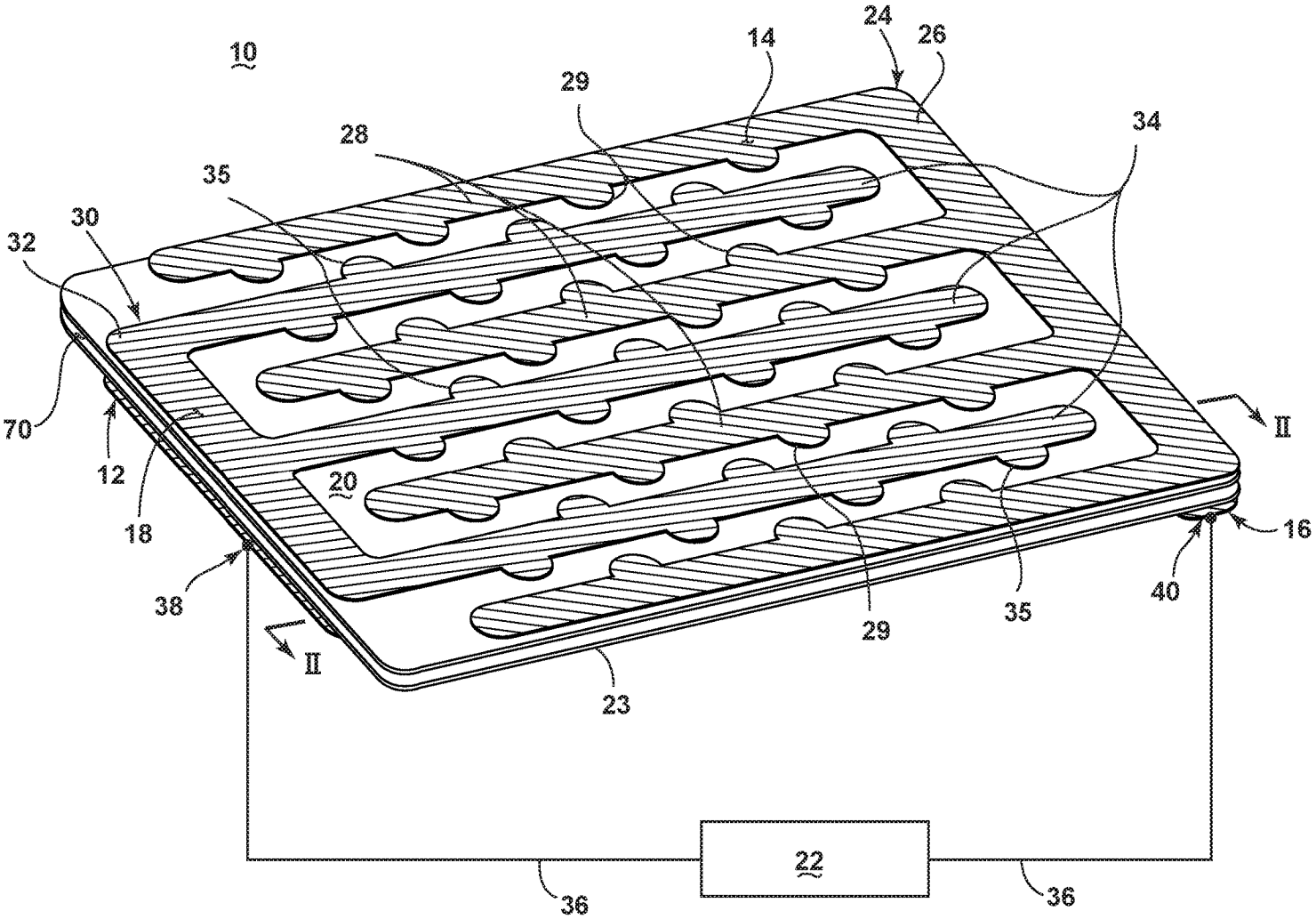
FIG. 1 is a schematic perspective view of the laundry treating applicator in accordance with the first embodiment of the invention.

FIG. 1 is a schematic illustration of a laundry drying applicator 10 according to the first embodiment of the invention for dehydrating one or more articles, such as articles of clothing. As illustrated in FIG. 1, the laundry drying applicator 10 has a structure that includes conductive elements, such as a first anode element 12 and a second anode element 18, and an opposing first cathode element 16, a second cathode element 14, in addition to a first non-conductive laundry support element 20, an optional second non-conductive support element 23, and an RF generator 22.

The second cathode element 14 further includes a first comb element 24 having a first base 26 from which extend a first plurality of teeth 28, and the second anode element 18 includes a second comb element 30 having a second base 32 from which extend a second plurality of teeth 34. The second cathode and second anode elements 14, 18 are fixedly mounted to the first supporting element 20 in such a way as to interdigitally arrange the first and second pluralities of teeth 28, 34.

Each of the first and second pluralities of teeth 28, 34 may further include a respective first and second pluralities of tabs 29, 35 on at least some of the teeth 28, 34. As shown, each of the first and second pluralities of tabs 29, 35 are semicircular or rounded projections that extend perpendicularly toward the opposing pluralities of teeth 28, 34. Additionally, the first and second pluralities of tabs 29, 35 may be offset from each other. Alternative geometric configurations of tab shape and placement of the pluralities of tabs 29, 35 relative to each other are envisioned.

The second cathode and second anode elements 14, 18 may be fixedly mounted to the first support element 20 by, for example, adhesion, fastener connections, or laminated layers. Additionally, the first cathode and anode elements 16, 12 are shown fixedly mounted to the second support element 23 by similar mountings. Alternative mounting techniques may be employed.

At least a portion of either the first or second support elements 20, 23 separates an at least partially aligned first cathode and second cathode elements 16, 14. As illustrated, the elongated first cathode element 16 aligns with the substantially rectangular first base 26 portion of the second cathode element 14, through the first support element 20 and second support element 23, with the support elements 20, 23 separated by an optional air gap 70. Similarly shown, the elongated first anode element 12 at least partially aligns with the substantially rectangular second base 32 portion of the second anode element 18 through a portion of the first support element 20 and second support element 23, with the support elements 20, 23 separated by an air gap 70. The aligned portions of the first and second cathode elements 16, 14 are oppositely spaced, on the supporting elements 20, 23, from the aligned portion of the first and second anode elements 12, 18.

The RF generator 22 may be configured to generate a field of electromagnetic radiation (e-field) within the radio frequency spectrum between outputs electrodes and may be electrically coupled between the first cathode element 16 and the first anode element 12 by conductors 36 connected to at least one respective first anode and cathode contact point 38, 40. One such example of an RF signal generated by the RF generator 22 may be 13.56 MHz. The generation of another RF signal, or varying RF signals, is envisioned.

Microwave frequencies are typically applied for cooking food items. However, their high frequency and resulting greater dielectric heating effect make microwave frequencies undesirable for drying laundry articles. Radio frequencies and their corresponding lower dielectric heating effect are typically used for drying of laundry. In contrast with a conventional microwave heating appliance, where microwaves generated by a magnetron are directed into a resonant cavity by a waveguide, the RF generator 22 induces a controlled electromagnetic field between the cathode and anode elements 12, 14, 16, 18, including the first and second pluralities of tabs 29, 35. Stray-field or through-field electromagnetic heating provides a relatively deterministic application of power as opposed to conventional microwave heating technologies where the microwave energy is randomly distributed (by way of a stirrer and/or rotation of the load). Consequently, conventional microwave technologies may result in thermal runaway effects or arcing that are not easily mitigated when applied to certain loads (such as metal zippers etc.). Stated another way, using a water analogy where water is analogous to the electromagnetic radiation, a microwave acts as a sprinkler while the above-described RF generator 22 is a wave pool. It is understood that the differences between microwave ovens and RF dryers arise from the differences between the implementation structures of an applicator vs. a tuned cavity, which renders much of the microwave solutions inapplicable for RF dryers.

Each of the conductive cathode and anode elements 16, 14, 12, 18, including the first and second pluralities of tabs 29, 35, remain at least partially spaced from each other by a separating gap, or by non-conductive segments, such as by the first and second support elements 20, 23, or by the optional air gap 70. The support elements 20, 23 may be made of any suitable low loss, fire retardant materials, or at least one layer of insulating materials that isolates the conductive cathode and anode elements 16, 14, 12, 18. The support elements 20, 23 may also provide a rigid structure for the laundry drying applicator 10, or may be further supported by secondary structural elements, such as a frame or truss system. The air gap 70 may provide enough separation to prevent arcing or other unintentional conduction, based on the electrical characteristics of the laundry drying applicator 10.

Figure 2:
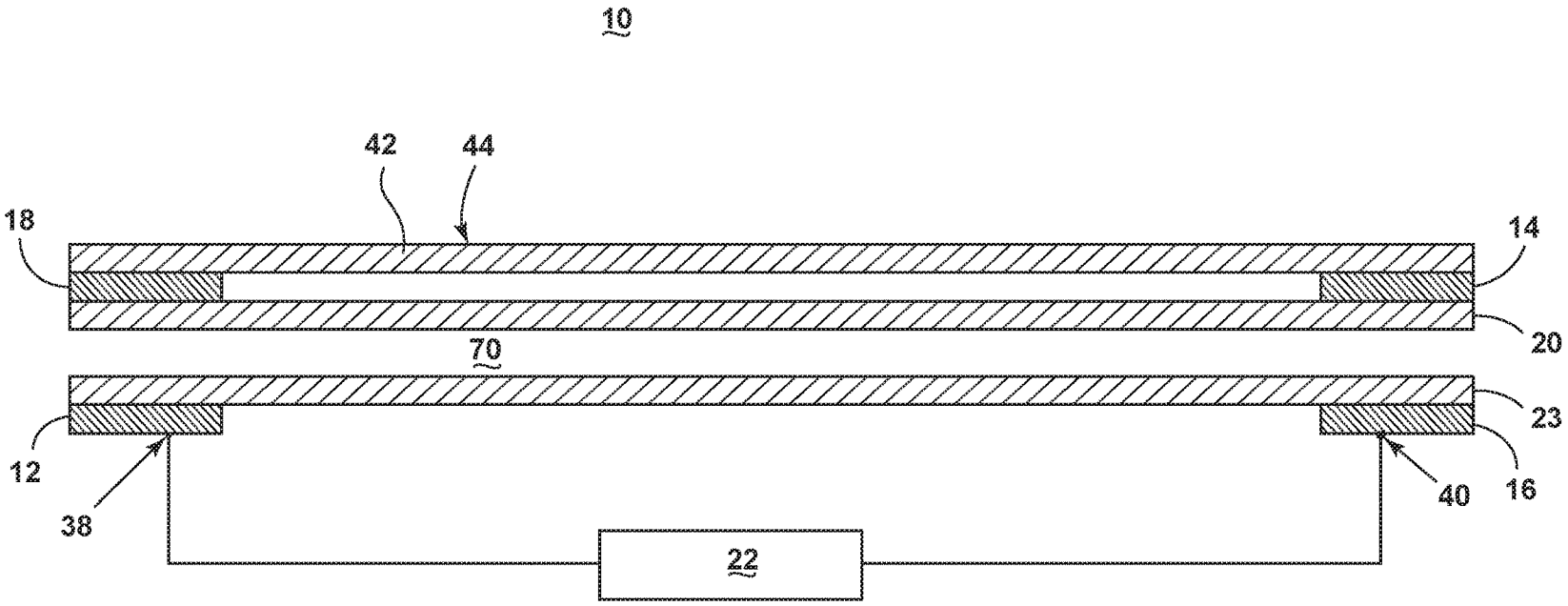
FIG. 2 is a partial sectional view taken along line 2-2 of FIG. 1 in accordance with the first embodiment of the invention.

Turning now to the partial sectional view of FIG. 2, taken along line II-II of FIG. 1 in accordance with the first embodiment of the invention, the first support element 20 may further include a non-conductive bed 42 wherein the bed 42 may be positioned above the interdigitally arranged pluralities of teeth 28, 34. The bed 42 further includes a substantially smooth and flat upper surface 44 for receiving wet laundry. The bed 42 may be made of any suitable low loss, fire retardant materials that isolate the conductive elements from the articles to be dehydrated.

The aforementioned structure of the laundry drying applicator 10 operates by creating a first capacitive coupling between the first anode element 12 and the second anode element 18 separated by at least a portion of the at least one support element 20, 23, a second capacitive coupling between the first cathode element 16 and the second cathode element 14 separated by at least a portion of the at least one support element 20, 23, and a third capacitive coupling between the pluralities of teeth 28, 34 and the pluralities of tabs 29, 35 of the second cathode element 14 and the second anode element 18, at least partially spaced from each other. During drying operations, wet laundry to be dried may be placed on the upper surface 44 of the bed 42. During, for instance, a predetermined cycle of operation, the RF generator 22 may be selectively, continuously, automatically or intermittently energized to generate an e-field between the first, second, and third capacitive couplings which interacts with liquid in the laundry. The liquid residing within the e-field will be dielectrically heated to effect a drying of the laundry.

Many other possible configurations in addition to that shown in the above figures are contemplated by the present embodiment. For example, one embodiment of the invention contemplates different geometric shapes for the laundry drying applicator 10, such as substantially longer, rectangular applicator 10 where the cathode and anode elements 16, 14, 12, 18 are elongated along the length of the applicator 10, or the longer applicator 10 includes a plurality of cathode and anode element 16, 14, 12, 18 sets. In such a configuration, the upper surface 44 of the bed 42 may be smooth and slightly sloped to allow for the movement of wet laundry or water across the laundry drying applicator 10, wherein the one or more cathode and anode element 16, 14, 12, 18 sets may be energized individually or in combination by one or more RF generators 22 to dry the laundry as it traverses the applicator 10. Alternatively, the bed 42 may be mechanically configured to move across the elongated laundry drying applicator 10 in a conveyor belt operation, wherein the one or more cathode and anode element 12, 14, 16, 18 sets may be energized individually or in combination by one or more RF generators 22 to dry the laundry as it traverses the applicator 10.

Additionally, a configuration is envisioned wherein only a single support element 20 separates the first cathode and anode elements 16, 12 from their respective second cathode and anode elements 14, 18. This configuration may or may not include the optional air gap 70. In another embodiment, the first cathode element 16, first anode element 12, or both elements 16, 12 may be positioned on the opposing side of the second support element 23, within the air gap 70. In this embodiment, the air gap 70 may still separate the elements 16, 12 from the first support element 20, or the elements 16, 12 may be in communication with the first support element 20.

In another envisioned configuration, the RF generator 22 is directly connected via conductors 36 to the second cathode element 14 and second anode element 18 at respective first cathode and first anode contact points 40, 38. In this configuration, only a single capacitive coupling between the second cathode and second anode elements 14, 18 occurs. Additionally, in this configuration, there may no longer be a need for the first cathode and first anode elements 16, 12, or the second support element 23.

Figure 3:
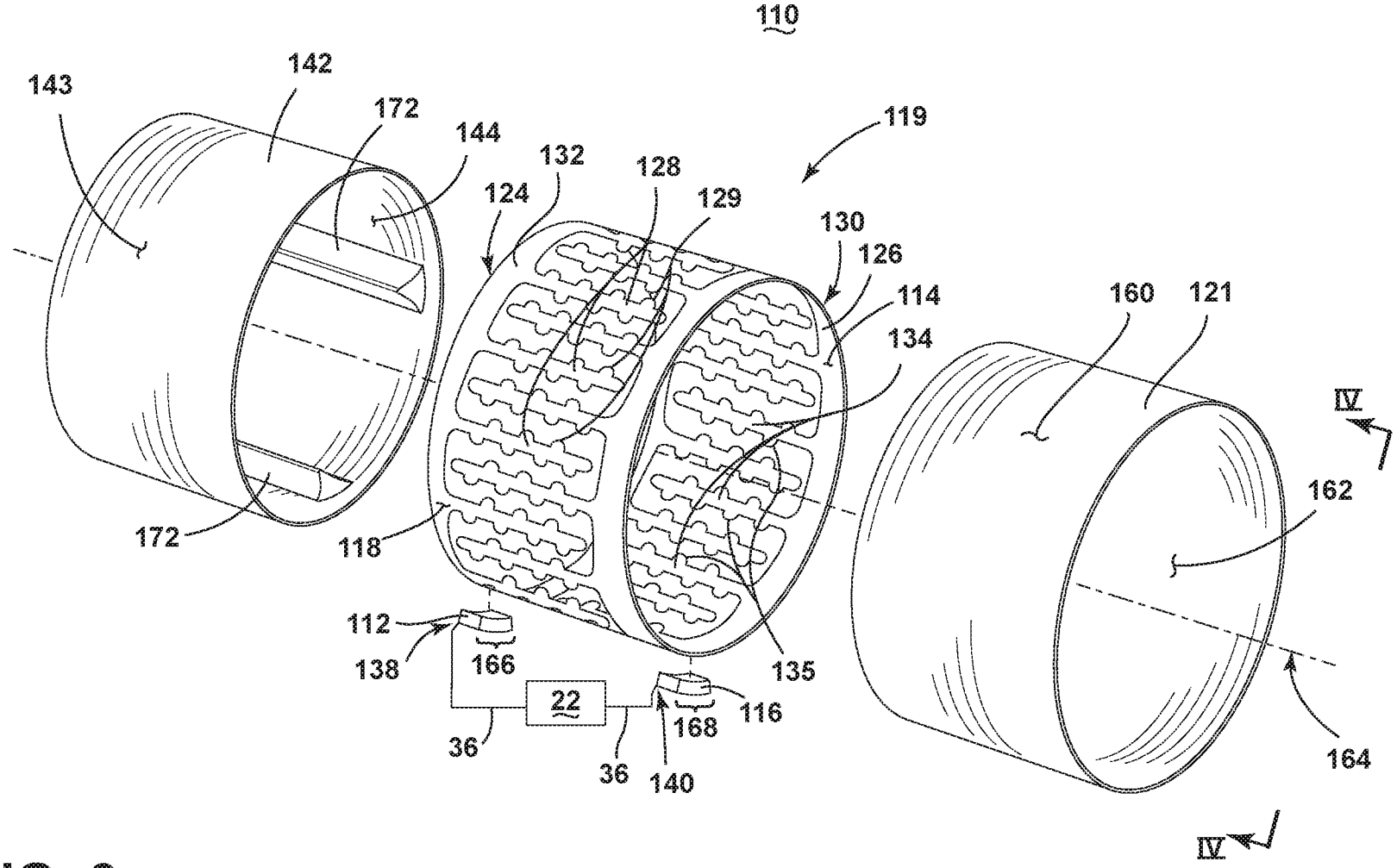
FIG. 3 is a schematic perspective view of an axially-exploded laundry treating applicator with a rotating drum configuration, in accordance with the second embodiment of the invention.

FIG. 3 illustrates an alternative laundry drying applicator 110 according to a second embodiment of the invention. The second embodiment may be similar to the first embodiment; therefore, like parts will be identified with like numerals increased by 100, with it being understood that the description of the like parts of the first embodiment applies to the second embodiment, unless otherwise noted. A difference between the first embodiment and the second embodiment may be that laundry drying applicator 110 may be arranged in a drum-shaped configuration rotatable about a rotational axis 164, instead of the substantially flat configuration of the first embodiment.

In this embodiment, the support element includes a drum 119 having a non-conducting outer drum 121 having an outer surface 160 and an inner surface 162, and may further include a non-conductive element, such as a sleeve 142. The sleeve 142 further includes an inner surface 144 for receiving and supporting wet laundry. The inner surface 144 of the sleeve 142 may further include optional tumble elements 172, for example, baffles, to enable or prevent movement of laundry. The sleeve 142 and outer drum 121 may be made of any suitable low loss, fire retardant materials that isolate the conductive elements from the articles to be dehydrated. While a sleeve 142 is illustrated, other non-conductive elements are envisioned, such as one or more segments of non-conductive elements, or alternate geometric shapes of non-conductive elements.

As illustrated, the conductive second cathode element 114, and the second anode elements 118 are similarly arranged in a drum configuration and fixedly mounted to the outer surface 143 of the sleeve 142. In this embodiment, the opposing first and second comb elements 124, 130 include respective first and second bases 126, 132 encircling the rotational axis 164, and respective first and second pluralities of teeth 128, 134, interdigitally arranged about the rotational axis 164.

Each of the first and second pluralities of teeth 128, 134 may further include a respective first and second pluralities of tabs 129, 135 on at least some of the teeth 128, 134. As shown, each of the first and second pluralities of tabs 129, 135 are semicircular projections that extend perpendicularly toward the opposing pluralities of teeth 128, 134. Additionally, the first and second pluralities of tabs 129, 135 may be offset from each other. Alternative geometric configurations of tab shape and placement of the pluralities of tabs 129, 135 relative to each other are envisioned.

The laundry drying applicator 110 further includes a conductive first anode element comprising at least a partial anode ring 112 encircling a first radial segment 166 of the drum 119 and an axially spaced opposing conductive first cathode element comprising at least a partial cathode ring 116 encircling a second radial segment 168 of the drum 119, which may be different from the first radial segment 166. As shown, at least a portion of the drum 119 separates the at least partially axially-aligned anode ring 112 and the second base 132 portion of the second anode elements 118. Similarly, at least a portion of the drum 119 separates the at least partially axially-aligned cathode ring 116 and the first base 126 portion of the second cathode element 114. Additionally, this configuration aligns the second base 132 with the first radial segment 166, and the first base 126 with the second radial segment 168. Alternate configurations are envisioned where only at least a portion of the drum 119 separates the cathode or anode rings 116, 112 from their respective second cathode and anode elements 114, 118 and first and second bases 126, 132.

The RF generator 22 may be configured to generate a field of electromagnetic radiation (e-field) within the radio frequency spectrum between outputs electrodes and may be electrically coupled between the anode ring 112 and the cathode ring 116 by conductors 36 connected to at least one respective cathode and anode ring contact point 140, 138.

Each of the conductive anode and cathode elements 112, 118, 116, 114, including the first and second pluralities of tabs 129, 135, remain at least partially spaced from each other by a separating gap, or by non-conductive segments, such as by the outer drum 121. The outer drum 121 may be made of any suitable low loss, fire retardant materials, or at least one layer of insulating materials that isolates the conductive anode and cathode elements 112, 118, 116, 114. The drum 119 may also provide a rigid structure for the laundry drying applicator 110, or may be further supported by secondary structural elements, such as a frame or truss system.

Figure 4:
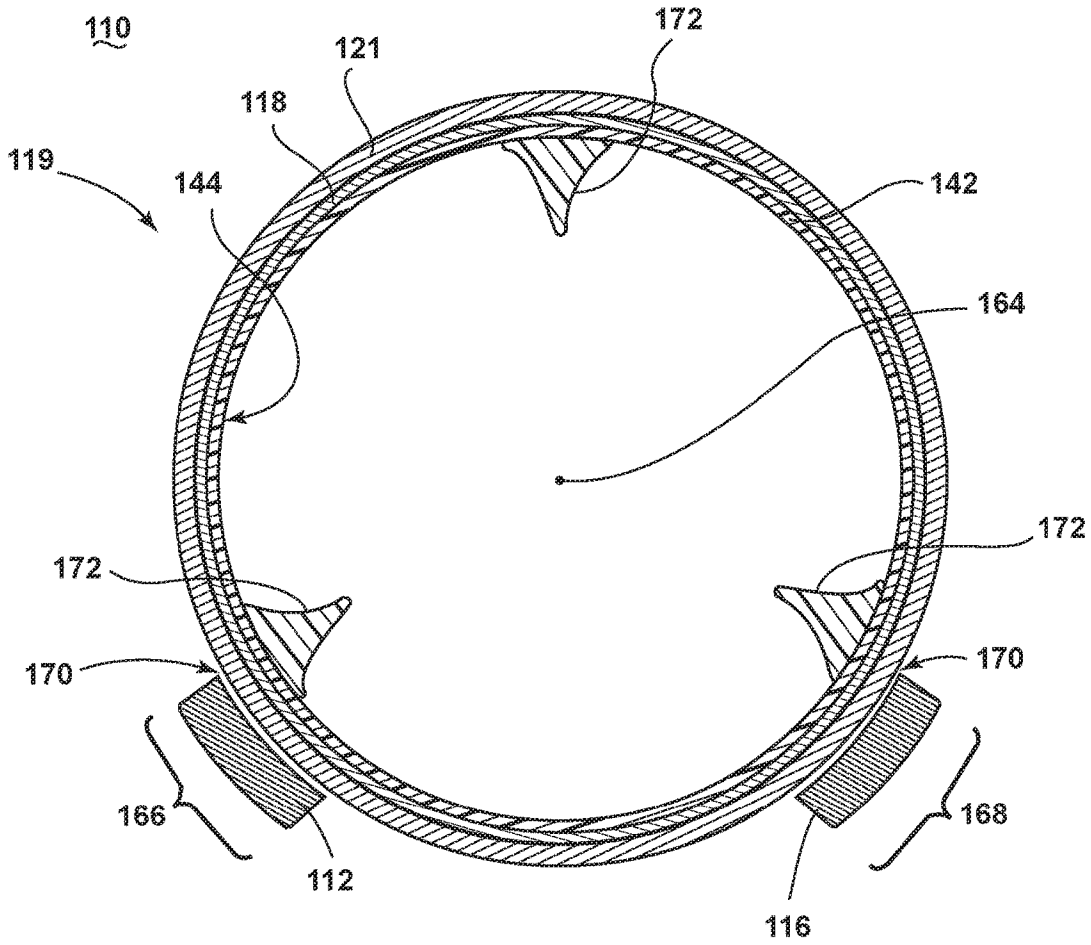
FIG. 4 is a partial sectional view taken along line 4-4 of FIG. 3 showing the assembled configuration of the drum and anode/cathode elements, in accordance with the second embodiment of the invention.

As shown in FIG. 4, the assembled laundry drying applicator 110, according to the second embodiment of the invention, creates a substantially radial integration between the sleeve 142, second cathode and anode elements 114, 118 (cathode element not shown), and drum 119 elements. It may be envisioned that additional layers may be interleaved between the illustrated elements. Additionally, while the anode ring 112 and cathode ring 116 are shown offset about the rotational axis for illustrative purposes, alternate placement of each ring 112, 116 may be envisioned.

The second embodiment of the laundry drying applicator 110 operates by creating a first capacitive coupling between the anode ring 112 and the second anode element 118 separated by at least a portion of the drum 119, a second capacitive coupling between the cathode ring 116 and the second cathode element 114 separated by at least a portion of the drum 119, and a third capacitive coupling between the pluralities of teeth 128, 134 and the pluralities of tabs 129, 135 of the second cathode element 114 and the second anode element 118, at least partially spaced from each other.

During drying operations, wet laundry to be dried may be placed on the inner surface 144 of the sleeve 142. During a cycle of operation, the drum 119 may rotate about the rotational axis 164 at a speed at which the tumble elements 172 may enable, for example, a folding or sliding motion of the laundry articles. During rotation, the RF generator 22 may be off, or may be continuously, selectively, automatically, or intermittently energized to generate an e-field between the first, second, and third capacitive couplings which interacts with liquid in the laundry. The liquid interacting with the e-field located within the inner surface 144 will be dielectrically heated to effect a drying of the laundry.

Many other possible configurations in addition to that shown in the above figures are contemplated by the present embodiment. For example, in another configuration, the cathode and anode rings 116, 112 may encircle larger or smaller radial segments, or may completely encircle the drum 119 at first and second radial segments 166, 168, as opposed to just partially encircling the drum 119 at a first and second radial segments 166, 168. In yet another configuration, the second cathode and/or anode elements 114, 118, the first and/or second bases 126, 132, and the first and/or second plurality of teeth 128, 134 may only partially encircle the drum 119 as opposed to completely encircling the drum 119. In even another configuration, the pluralities of teeth 28, 34, 128, 134 or the pluralities of tabs 29, 35, 129, 135 may be supported by slotted depressions in the support element 20 or sleeve 142 matching the teeth 28, 34, 128, 134 or tabs 29, 35, 129, 135 for improved dielectric, heating, or manufacturing characteristics of the applicator 10. In another configuration, the second cathode and anode elements 114, 118 may only partially extend along the outer surface 143 of the sleeve 142.

In another envisioned configuration, the RF generator 22 is directly connected via conductors 36 to the second cathode element 114 and second anode element 118 at respective anode and cathode contact points 138, 140. In this configuration, only a single capacitive coupling between the second cathode and second anode elements 114, 118 occurs. Additionally, in this configuration, there may no longer be a need for the anode and cathode rings 112, 116.

In an alternate operation of the second embodiment, the RF generator 22 may be intermittently energized to generate an e-field between the first, second, and third capacitive couplings, wherein the intermittent energizing may be related to the rotation of the drum 119, or may be synchronized to correspond with one of aligned capacitive couplings, tumbling of the laundry, or power requirements of the laundry drying applicator 110. In another alternate operation of the second embodiment, the RF generator 22 may be moving during the continuous or intermittent energizing of the e-field between the first, second, and third capacitive couplings. In yet another alternate operation of the second embodiment, the drum may be rotationally stopped or rotationally slowed while the RF generator 22 continuously or intermittently energizes to generate an e-field between the first, second, and third capacitive couplings.

Figure 5:
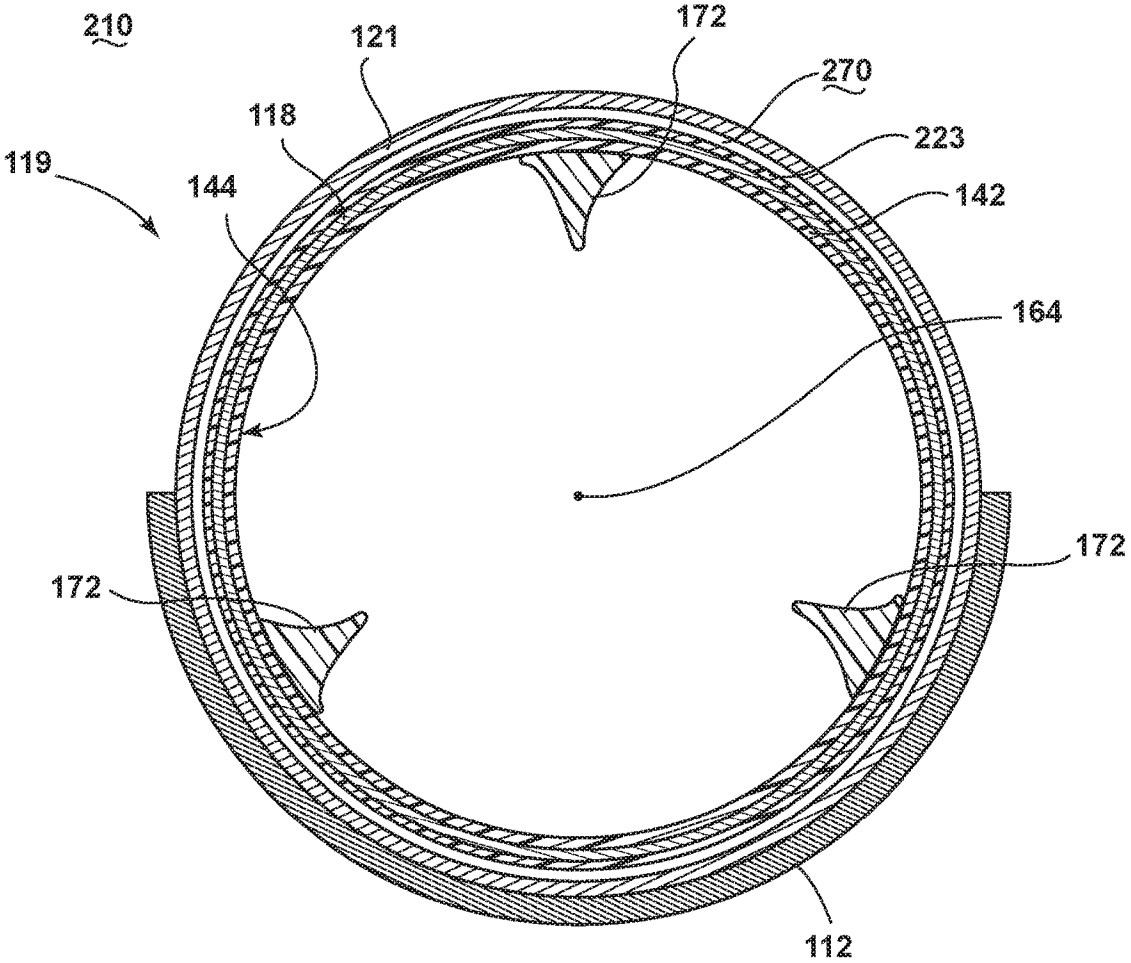
FIG. 5 is a partial sectional view showing an alternate assembled configuration of the drum and anode/cathode elements, in accordance with the third embodiment of the invention.

FIG. 5 illustrates an alternative assembled laundry drying applicator 210, according to the third embodiment of the invention. The third embodiment may be similar to the first and second embodiments; therefore, like parts will be identified with like numerals increased by 200, with it being understood that the description of the like parts of the first embodiment applies to the second embodiment, unless otherwise noted. A difference between the first embodiment and the second embodiment may be that laundry drying applicator 210 may be arranged in a drum-shaped configuration, wherein the outer drum 121 is separated from the second anode element 118 by a second drum element 223 and an air gap 270.

Additionally, the same anode ring 112 and cathode ring 116 (not shown) are elongated about a larger radial segment of the drum 119. Alternatively, the cathode ring 116, anode ring 112, or both rings 112, 116 may be positioned on the opposing side of the outer drum 121, within the air gap 270. In this embodiment, the air gap 270 may still separate the elements 112, 116 from the second drum element 223, or the elements 112, 116 may be in communication with the second drum element 223. The operation of the third embodiment is similar to that of the second embodiment.

Figure 6:
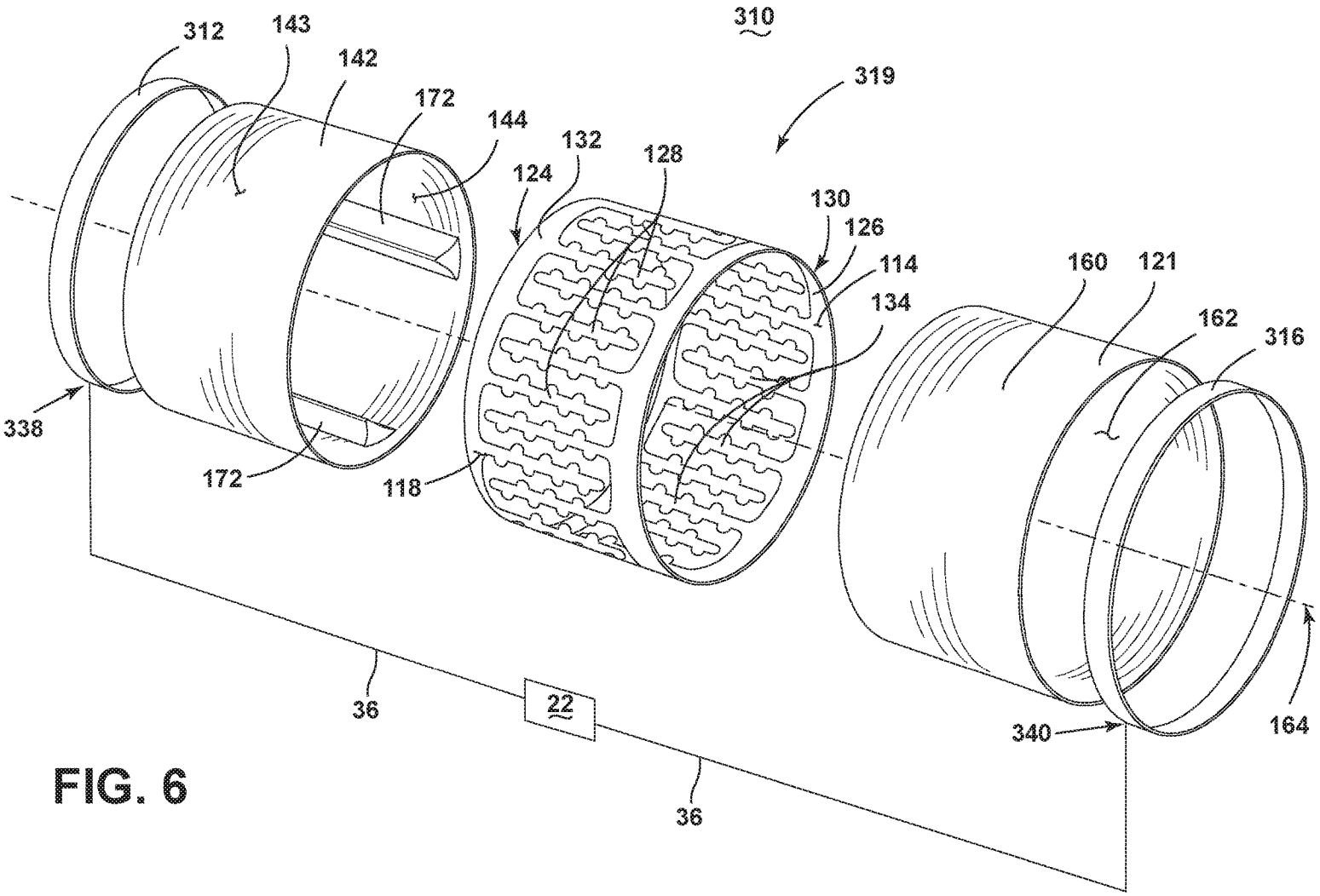
FIG. 6 is a schematic perspective view of an axially-exploded laundry treating applicator with a rotating drum configuration having integrated anode/cathode rings, in accordance with the fourth embodiment of the invention.

FIG. 6 illustrates an alternative laundry drying applicator 310 according to a fourth embodiment of the invention. The fourth embodiment may be similar to the second or third embodiments; therefore, like parts will be identified with like numerals beginning with 300, with it being understood that the description of the like parts of the first and second embodiments apply to the third embodiment, unless otherwise noted. A difference between the second embodiment and the third embodiment may be that first anode and cathode elements include anode and cathode rings 312, 316 assembled at axially opposite ends of the drum 319. This configuration may be placed within a housing, for instance, a household dryer cabinet (not shown).

In this embodiment, the assembled anode and cathode rings 312, 316 are electrically isolated by, for example, at least a portion of the drum 319 or air gap (not shown). In this sense, the laundry drying applicator 310 retains the first and second capacitive couplings of the second embodiment.

The RF generator 22 may be configured to generate a field of electromagnetic radiation (e-field) within the radio frequency spectrum between outputs electrodes and may be electrically coupled between the anode ring 312 and the cathode ring 316 by conductors 36 connected to at least one respective anode and cathode ring contact point 338, 340. In this embodiment, the anode and cathode ring contact points 338, 340 may further include direct conductive coupling through additional components of the dryer cabinet supporting the rotating drum 319, such as via ball bearings (not shown). Other direct conductive coupling through additional components of the dryer cabinet may be envisioned.

The fourth embodiment of the laundry drying applicator 310 operates by creating a first capacitive coupling between the anode ring 312 and the second anode element 118 separated by at least a portion of the drum 319 or air gap, a second capacitive coupling between the cathode ring 316 and the second cathode element 114 separated by at least a portion of the drum 319 or air gap. During rotation, the RF generator 22 may be off, or may be continuously, selectively, automatically, or intermittently energized to generate an e-field between the first, second, and third capacitive couplings which interacts with liquid in the laundry. The liquid interacting with the e-field located within the inner surface 144 will be dielectrically heated to effect a drying of the laundry.

In another envisioned configuration, the anode ring 312 is directly connected to the second anode element 118 and the cathode ring 316 is directly connected to the second cathode element 114. In this configuration, only a single capacitive coupling between the second anode and second cathode elements 118, 114 occurs.

Figure 7:
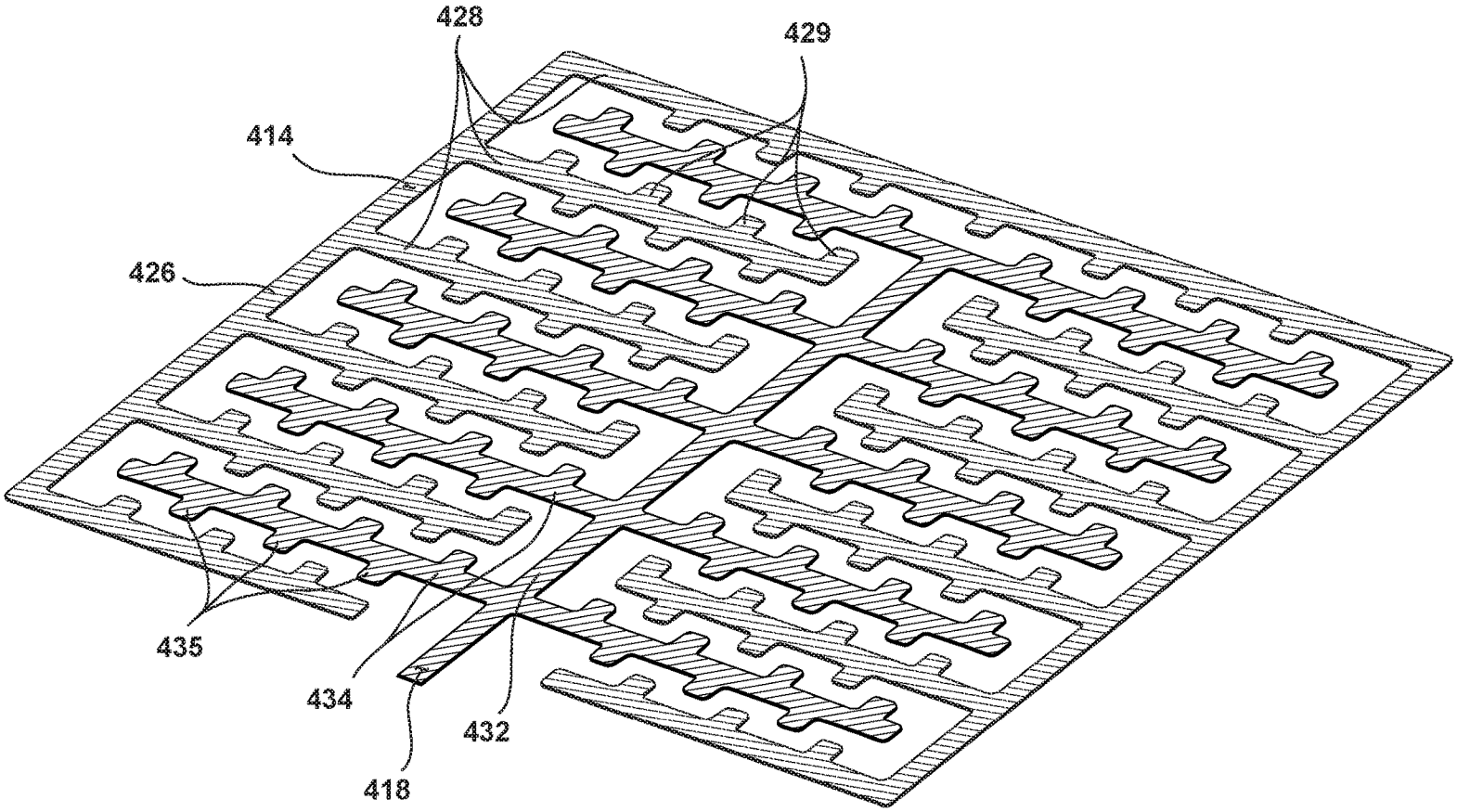
FIG. 7 is a schematic perspective view of an alternative anode/cathode configuration in accordance with the fifth embodiment of the invention.

FIG. 7 illustrates an alternative cathode and anode structure, according to the fifth embodiment of the invention. The fifth embodiment may be similar to the cathode and anode structure of the first embodiment; therefore, like parts will be identified with like numerals increased by 400, with it being understood that the description of the like parts of the first embodiment applies to the fifth embodiment, unless otherwise noted. A difference between the first embodiment and the fifth embodiment may be that cathode element 414 and anode element 418 may be arranged in a tree-shaped configuration, as illustrated. In this configuration, the second plurality of teeth 434 extend from both sides of a centrally located second base 432, compared to the first embodiment, wherein the second plurality of teeth 34 extends only from a single side of the second base 32. Additionally, the first base 426 extends around the second plurality of teeth 434, and is configured such that the first plurality of teeth 428 is interdigitally arranged with both sides of the second plurality of teeth 434.

Figure 8:
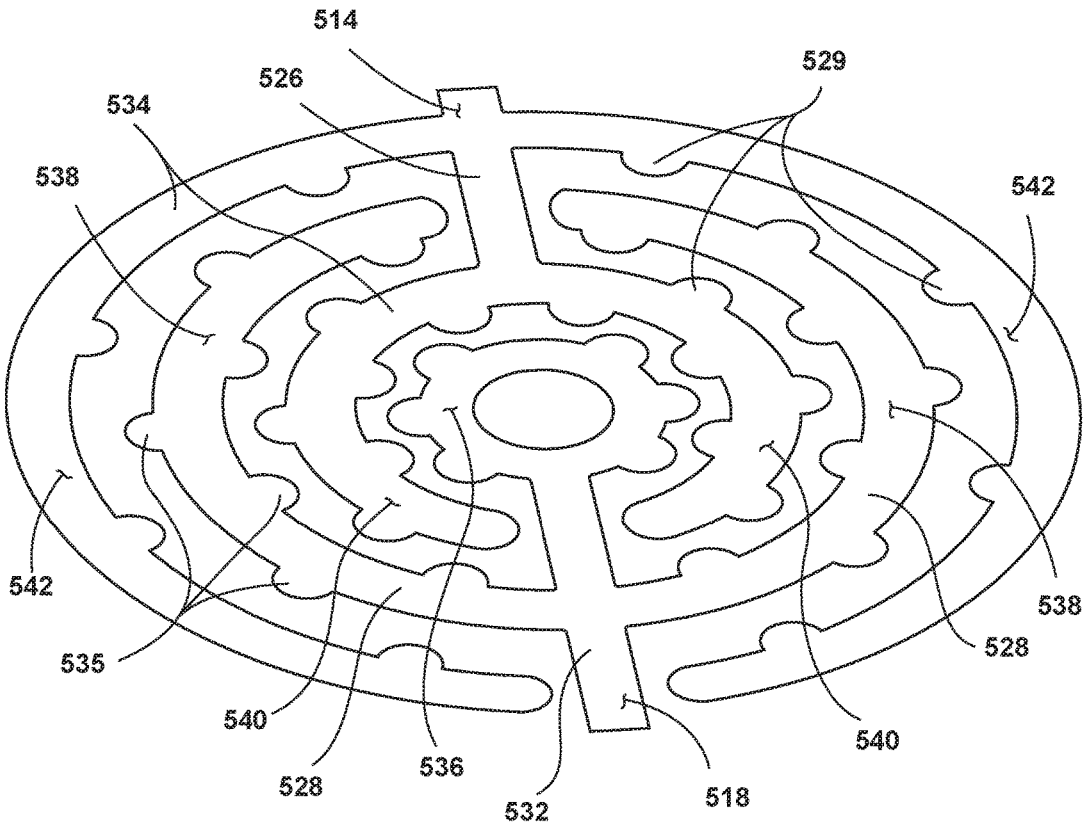
FIG. 8 is a schematic perspective view of an alternative anode/cathode configuration in accordance with the sixth embodiment of the invention.

FIG. 8 illustrates an alternative cathode and anode structure, according to the sixth embodiment of the invention. The sixth embodiment may be similar to the cathode and anode structure of the first and fifth embodiment; therefore, like parts will be identified with like numerals increased by 500, with it being understood that the description of the like parts of the first and fifth embodiments applies to the sixth embodiment, unless otherwise noted. A difference between the first and fifth embodiments and the sixth embodiment may be that cathode element 514 and anode element 518 may be arranged in a circular-shaped configuration, as illustrated. In this configuration, the first plurality of teeth 528 includes centrally located second base 532 formed of an annular ring 536 and a first radially extending arm 538. Some of the first plurality of teeth 528 extend annularly from both sides of the radially extending arm 538 about the annular ring 536. Additionally, the first base 526 includes at least a second radially extending arm 540, annularly aligned with the first radially extending arm 538 and the annular ring 536, and the second plurality of teeth 534 extending and interdigitally arranged with the first plurality of teeth 528. As shown, the first base 526 further includes a third radially extending arm 542, annularly aligned with and encircling the first radially extending arm 538.

Figure 9:
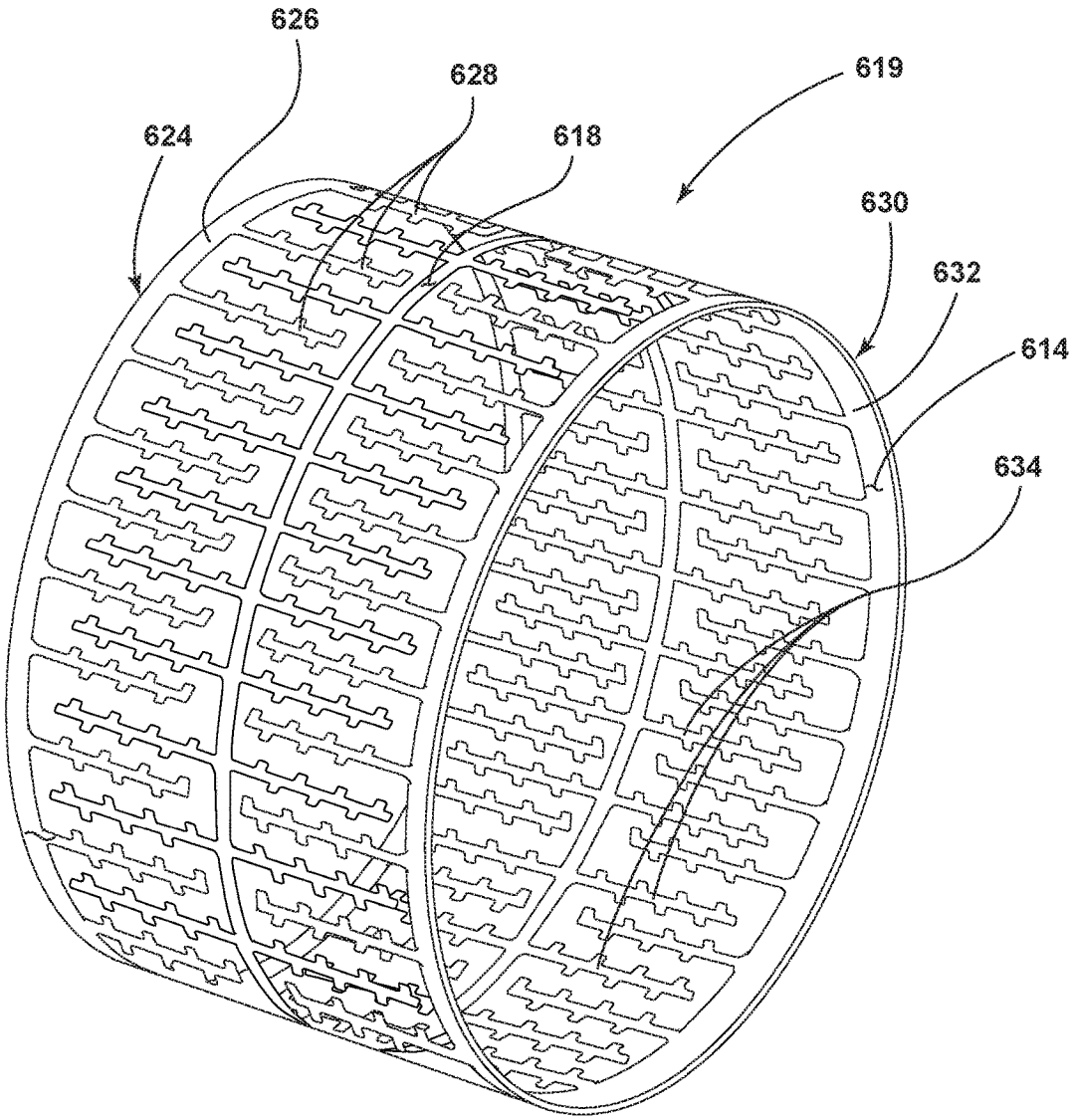
FIG. 9 is a schematic perspective view of an alternative anode/cathode drum configuration in accordance with the seventh embodiment of the invention.

FIG. 9 illustrates an alternative cathode and anode structure, according to the seventh embodiment of the invention. The seventh embodiment may be similar to the cathode and anode structure of the first, second, third, fourth, and fifth embodiments; therefore, like parts will be identified with like numerals increased by 600, with it being understood that the description of the like parts of the first, second, third, fourth, and fifth embodiments embodiment applies to the seventh embodiment, unless otherwise noted. A difference between the first, second, third, fourth, and fifth embodiments and the fifth embodiment may be that anode element 618 and cathode element 614 may be arranged in a tree-shaped drum configuration, as illustrated. In this configuration, the second plurality of teeth 634 extend from both sides of a centrally located second base 632, compared to, for instance, the second embodiment, wherein the second plurality of teeth 634 extends only from a single side of the second base 632.

As shown, a separate anode element 618 is axially spaced on either end by the second cathode element 614, however the cathode elements 614 may alternatively be coupled to one another. The first base 626 extends around the second plurality of teeth 634, and is configured such that the first plurality of teeth 628 is interdigitally arranged with both sides of the second plurality of teeth 634. It is envisioned this configuration may have multiple cathode rings corresponding to the multiple second cathode elements 614, wherein the multiple cathode rings are configured to be synchronously energize via the RF generator 22 (not shown).

Figure 10:
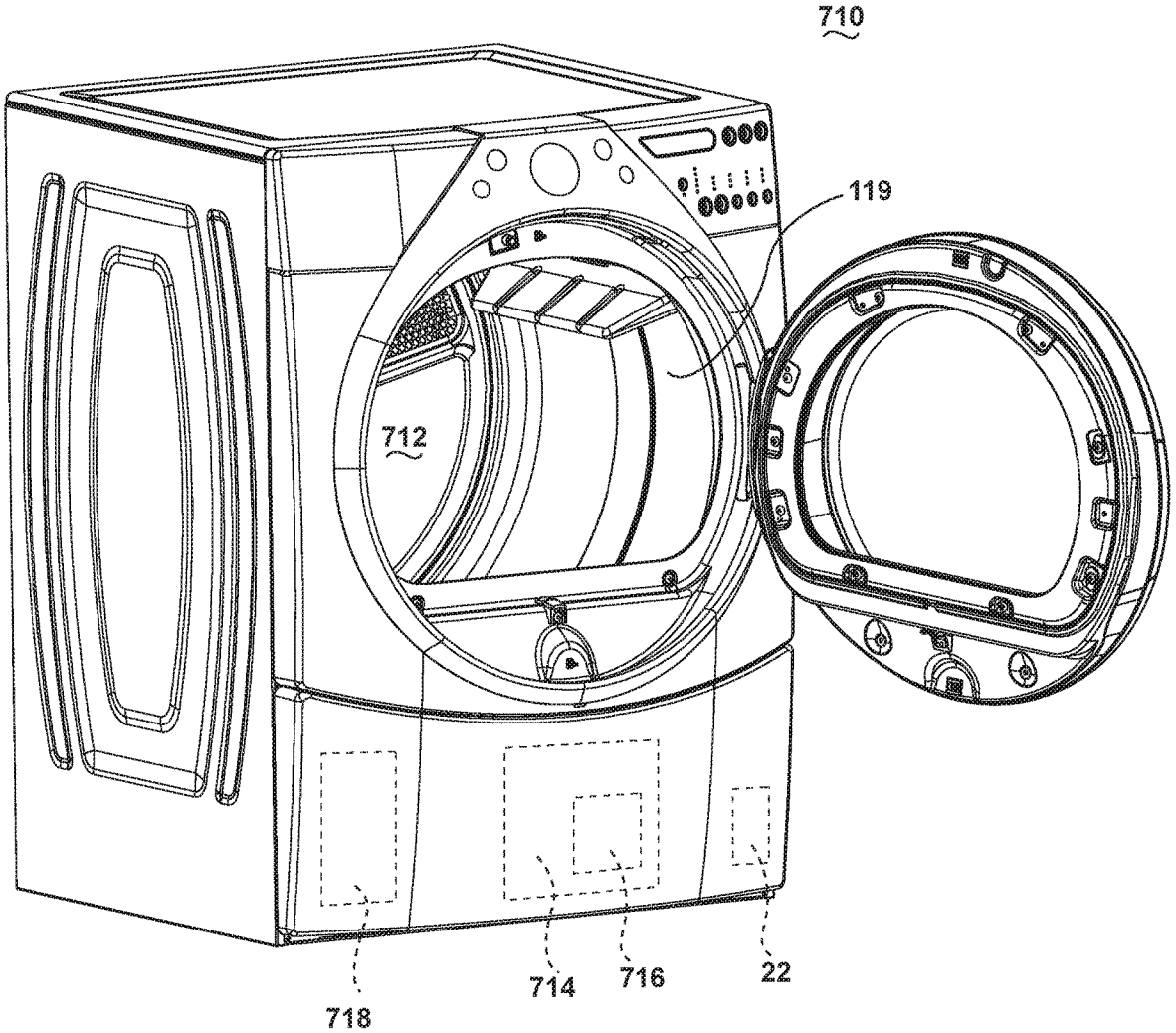
FIG. 10 is a schematic perspective view of an embodiment where the laundry treating appliance is shown as a clothes dryer incorporating the drum of the second, third, fourth, and seventh embodiments.

FIG. 10 illustrates an embodiment where the aforementioned applicator may be included in a laundry treating appliance, such as a clothes dryer 710, incorporating the drum 119, 319 (illustrated as drum 119), which defines a treating chamber 712 for receiving laundry for treatment, such as drying. The clothes dryer comprises an air system 714 supplying and exhausting air from the treating chamber, which includes a blower 716. A heating system 718 is provided for hybrid heating the air supplied by the air system 714, such that the heated air may be used in addition to the dielectric heating. The heating system 718 may work in cooperation with the laundry drying applicator 110, as described herein. Additional drying appliances embodiments are envisioned, for example, vertical axis clothes dryers.

Many other possible embodiments and configurations in addition to those shown in the above figures are contemplated by the present disclosure. For example, alternate geometric configurations of the first and second pluralities of teeth or pluralities of tabs are envisioned wherein the configuration of the teeth or tabs are designed to provide optimal electromagnetic coupling while keeping their physical size to a minimum. Additionally, the spacing between the pluralities of teeth and tabs may be larger or smaller than illustrated.

The embodiments disclosed herein provide a laundry treating applicator using RF applicator to dielectrically heat liquid in wet articles to effect a drying of the articles. One advantage that may be realized in the above embodiments may be that the above described embodiments are able to dry articles of clothing during rotational or stationary activity, allowing the most efficient e-field to be applied to the clothing for particular cycles or clothing characteristics. A further advantage of the above embodiments may be that the above embodiments allow for selective energizing of the RF applicator according to such additional design considerations as efficiency or power consumption during operation.

Additionally, the design of the anode and cathode may be controlled to allow for individual energizing of particular RF applicators in a single or multi-applicator embodiment. The effect of individual energization of particular RF applicators results in avoiding anode/cathode pairs that would result in no additional material drying (if energized), reducing the unwanted impedance of additional anode/cathode pairs and electromagnetic fields inside the drum, and an overall reduction to energy costs of a drying cycle of operation due to increased efficiencies. Finally, reducing unwanted fields will help reduce undesirable coupling of energy into isolation materials between capacitive coupled regions.

Furthermore, the design of the corresponding pluralities of tabs may allow for maximum electromagnetic field application between the anode and cathode elements due to the increased surface area. Additionally, by rounding the corners of the pluralities and tabs and pluralities of teeth, the anode and cathode elements may be energized with higher power with less chance of arcing. The maximum electromagnetic field application and higher power directly enhances the thermal performance of the laundry drying applicator.

Moreover, the capacitive couplings in embodiments of the invention allow the drying operations to move or rotate freely without the need for physical connections between the RF applicator and the pluralities of teeth. Due to the lack of physical connections, there will be fewer mechanical couplings to moving or rotating embodiments of the invention, and thus, an increased reliability applicator.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A laundry drying applicator to dry an article, comprising:

a support element;

a first anode element and a first cathode element;

a second anode element capacitively coupled with the first anode element and operably separated by at least a portion of the support element, and having a first base from which extends a first plurality of teeth; and a first plurality of tabs on at least some of the first plurality of teeth;

a second cathode element capacitively coupled with the first cathode element and operably separated by at least a portion of the support element and having a second base from which extends a second plurality of teeth and a second plurality of tabs on at least some of the second plurality of teeth wherein the first and second plurality of teeth are interdigitally arranged; and a radio frequency (RF) generator coupled with the first anode element and the first cathode element and operable to energize the first anode element and the first cathode element;

wherein upon energization of the first anode element and the first cathode element by the RF generator, the capacitive coupling of the second anode element and the second cathode element generates a field of electromagnetic radiation (e-field) in the radio frequency spectrum, operable to dielectrically heat liquid within an article on the support element.

2. The laundry drying applicator of claim 1 wherein the energization of the first anode element and the first cathode element by the RF generator induces the energization between the first anode element and the second anode element, between the first cathode element and the second cathode element, and between the second anode element and the second cathode element.

3. The laundry drying applicator of claim 1 wherein the first and second plurality of tabs are offset from each other.

4. The laundry drying applicator of claim 1 wherein the support element comprises at least one of a bed or a rotatable drum disposed above the second anode element and the second cathode element.

5. The laundry drying applicator of claim 4 wherein a rotation of the rotatable drum is synchronized to the energization of the RF generator to correspond with at least one of alignment with at least one capacitive coupling, a tumble of the laundry, or a power requirement of the RF generator.

6. The laundry drying applicator of claim 4 wherein the RF generator operably rotates with the drum.

7. The laundry drying applicator of claim 4 wherein the e-field is located above at least a portion of an inner surface of the drum and the article is supported on the inner surface of the drum.

8. The laundry drying applicator of claim 4 wherein the RF generator is intermittently energizable.

9. The laundry drying applicator of claim 4 wherein the first anode element comprises an anode ring encircling a first radial segment of the drum, and the first cathode element comprises a cathode ring encircling a second radial segment of the drum, which is different from the first radial segment.

10. The laundry drying applicator of claim 9 wherein the first base is axially aligned with the first radial segment and the second base is axially aligned with the second radial segment.

11. The laundry drying applicator of claim 1 wherein at least one of the second anode element or the second cathode element are encapsulated within the support element.

12. The laundry drying applicator of claim 1 wherein the support element comprises at least a layer of insulating material.

13. The laundry drying applicator of claim 1 wherein the first base is centrally located relative to the second cathode element and the first plurality of teeth extends from both sides of the first base, and wherein the second base extends around the first plurality of teeth, such that the second plurality of teeth are interdigitally arranged with the both sides of the first plurality of teeth.

14. The laundry drying applicator of claim 1 wherein at least one corner of at least one of the first anode element, the second anode element, the first cathode element, the second cathode element, the first plurality of teeth, the second plurality of teeth, the first plurality of tabs, or the second plurality of tabs is rounded.

15. A method to dry an article with a radio frequency (RF) applicator having a first anode element, a second anode element having a first base from which extends a first plurality of teeth and a first plurality of tabs on at least some of the first plurality of teeth, a first cathode element, a second cathode element having a second base from which extends a second plurality of teeth and a second plurality of tabs on at least some of the second plurality of teeth, each second anode and second cathode elements supported on a support element, the method comprising:

capacitively coupling, through the support element, the first anode element to the second anode element and the first cathode element to the second cathode element;

capacitively coupling the second anode element to the second cathode element; and energizing the RF applicator to energize the first anode element and the first cathode element, to generate a field of electromagnetic radiation (e-field) within a radio frequency spectrum between the second anode and second cathode elements;

wherein liquid in the article residing within the e-field will be dielectrically heated to effect a drying of the article.

16. The method of claim 15, wherein the energizing further includes energizing the RF applicator to energize the first anode element and the first cathode element, thereby inducing energization between the first anode element and the second anode element, and between the first cathode element and the second cathode element, to generate the e-field between the second anode and the second cathode elements.

17. The method of claim 15, further comprising moving the RF applicator during the energization of the RF applicator.

18. The method of claim 15 wherein the support element is in the shape of a rotatable drum and rotation of the drum is at a speed to effect a tumble motion of the article on the inner surface.

19. The method of claim 15 wherein the energizing further includes energizing the first anode element and the first cathode element, to generate an e-field between at least one of the first and second pluralities of teeth or the first and second pluralities of tabs.

20. The method of claim 15 wherein the energizing further includes energizing the first anode element and the first cathode element, to generate an e-field between the first and second pluralities of teeth and the first and second pluralities of tabs.

* * * * *